US005957269A

United States Patent [19]

Sahashi et al.

[11] Patent Number: 5,957,269

[45] Date of Patent: Sep. 28, 1999

[54] WATERTIGHT STRUCTURE OF MOUNTING PORTION

[75] Inventors: Kazuharu Sahashi; Yasuyoshi Kawada; Yukihiko Umeda; Masahiro Kasai; Tatsumi Tashiro, all of Aichi, Japan

[73] Assignee: Kabushiki Kaisha Tokai Denki Seisakusho, Aichi, Japan

[21] Appl. No.: 08/902,903

[22] Filed: Jul. 30, 1997

[30] Foreign Application Priority Data

Jul. 30, 1996 [JP] Japan ..... 8-200173

[51] Int. Cl.[6] ..... H01H 9/04

[52] U.S. Cl. ..... 200/296; 200/302.1; 200/61.81; 411/424; 439/559

[58] Field of Search ..... 200/302.1, 302.2, 200/302.3, 296, 294, 61.81, 61.82, 345; 296/146.1, 152; 439/556, 559; 411/423, 424, 379

[56] References Cited

U.S. PATENT DOCUMENTS 1,503,238 7/1924 Gall ..... 439/559 X
3,243,835 4/1966 Armantrout et al. ..... 439/559 X
4,231,631 11/1980 Guerinault et al. ..... 439/559
4,877,364 10/1989 Sorrenntino ..... 411/424 X
5,063,277 11/1991 Takano et al. ..... 200/345 X

*Primary Examiner*—Renee S. Luebke
*Attorney, Agent, or Firm*—Morgan, Lewis & Bockius LLP

[57] ABSTRACT

A mounting bolt 30 has a disclike flange portion 30*b* formed on an end of a tightening portion 30*a*. A switch bracket 28 is fixed to a screw hole 12 by tightening the bolt 30 with the bolt 30 inserted into a mounting hole 29 formed so as to have the same diameter as the screw hole 12. A rubber cover 21 covers the switch bracket 28, and has an annular seal portion 21*a* formed thereon. The seal portion 21*a* is larger in diameter than the mounting hole 29 and smaller in diameter than the flange portion 30*b*. A stepped portion 30*c* is formed on the bolt 30 in such a manner that a surface of contact thereof with the bracket 28 extends in parallel to the bracket 28, that the diameter thereof is larger than the mounting hole 29 and smaller than the seal portion 21*a*, and that the length thereof in an axial direction is such that the flange portion 30*b* biases the seal portion 21*a* at the time of tightening the bolt 30.

4 Claims, 3 Drawing Sheets

WATERTIGHT STRUCTURE OF MOUNTING PORTION

BACKGROUND OF THE INVENTION

1. Field of the Invention

The invention relates to watertight structures, and more particularly, to a watertight structure implemented by tightening a mounting bolt.

2. Related Art

Conventionally, there is a switch in an automobile, which turns on or off a room lamp or the like as a door is opened or closed. This switch is provided to visibly warn the driver or the like that he or she has forgotten to close a door or that he or she has closed a door incompletely by causing the switch to turn off the room lamp or the like. More specifically, this switch is attached to a panel of the body of an automobile which confronts a door, and turns off an illuminating room lamp or the like when the distance between the door and the panel equals a predetermined value as the door is closed, i.e., when the distance equals such a value as to be judged that the door is completely closed. Since the switch is necessarily disposed in the vicinity of the door, water droplets are easy to deposit on the switch in rainy weather or the like. It is for this reason that watertightness is called for in both the switch and the mounting portion of the switch.

FIG. 3 shows such a switch. A switch insertion hole 11 and a screw hole 12 are formed in a panel 10 that serves as a fixed member of the body of an automobile which confronts a door (not shown). Part of a watertight switch (hereinafter referred to simply as the "switch") 20 is inserted into the switch insertion hole 11. The outer surface of the switch 20 projecting from the panel 10 is covered with a rubber cover 21 that serves as a watertight member, so that entrance of water droplets or the like into the inside of the panel 10 is prevented.

The switch 20 is roughly divided into two parts: a switch portion 22, and a mounting portion 23. The switch portion 22 has a projected portion 24 that projects in a vertical direction (projecting direction) from the outside of the panel 10. The projected portion 24 is formed so that the door abuts thereagainst. The projected portion 24 is thus biased by the door in a direction indicated by the arrow A when the door is closed. Further, inside the projected portion 24 is a movable contact 25, which is supported so as to vertically reciprocate with respect to the panel 10. The movable contact 25 is urged toward the outside of the panel 10 by the elasticity of an elastic body (not shown), e.g., a spring. When the projected portion 24 is biased in the direction indicated by the arrow A as the door has been closed, the movable contact 25 moves toward the inside of the panel 10 against the elasticity of the elastic body.

Further, the switch portion 22 has a fixed contact 26, and the fixed contact 26 confront the movable contact 25 at a distance therebetween. The fixed contact 26 is connected to an ECU (not shown) that is mounted on the vehicle through a connector 27 and that generally controls the vehicle. When the projected portion 24 is biased in the direction indicated by the arrow A by the door, the movable contact 25 moves toward the inside of the panel 10 together with the projected portion 24, and the movable contact 25 comes in contact with the fixed contact 26 when the distance between the door and the panel becomes equal to such a value as to be judged that the door has been completely closed.

The switch 20 has a switch bracket 28 formed in the rubber cover 21. The switch bracket 28 serves as a member to be fixed which extends from the switch portion 22 to the mounting portion 23. This switch bracket 28 is made of metal, and is electrically connected to the movable contact 25. It may be noted that the surface 10*a* of the panel 10 is provided with a coating (not shown), so that the switch bracket 28 and the panel 10 is insulated. The switch bracket 28 has a mounting hole 29 formed therein at the same position as the screw hole 12. A barring bent portion 29*a* is formed on the mounting hole 29 so that the barring bent portion 29*a* projects in a vertical direction from the outside of the panel 10 in annular form. The aperture of the barring bent portion 29*a* has substantially the same diameter as the screw hole 12. The barring bent portion 29*a* is formed by bending the switch bracket 28.

On the other hand, the mounting bolt 30 for fixing the switch 20 to the panel 10 is made of metal, and has a hexagonal tightening portion 30*a* formed on one end thereof so that the mounting bolt 30 can be tightened by a spanner or the like. A disclike flange portion 30*b* is integrally formed on the tightening portion 30*a,* the flange portion 30*b* having a diameter larger than the tightening portion 30*a*. The flange portion 30*b* comes in contact with the barring bent portion 29*a* at the time of tightening the mounting bolt 30. The switch bracket 28 is electrically connected to the body by the flange portion 30*b* through the mounting bolt 30 and the screw hole 12 of the panel 10 (body earth). That is, the movable contact 25 that is connected to the switch bracket 28 is electrically connected to the body. When the door has been completely closed, both the contacts 25, 26 of the switch 20 come in contact with each other as described above. Then, the switch 20 applies a signal indicating that the door has been completely closed to the ECU through the connector 27, and the ECU turns on the room lamp or the like based on such signal.

As shown in FIG. 4, a seal portion 21*a*, which is an annular projected portion, is formed on the rubber cover 21 that is put around the outer circumference of the barring bent portion 29*a* in such a manner that the seal portion 21*a* becomes higher than the barring bent portion 29*a* in annular form. As shown in FIG. 3, the flange portion 30*b* of the mounting bolt 30 not only comes in contact with the barring bent portion 29*a* but also compresses the seal portion 21*a* so as to be in intimate contact therewith at the time of tightening the mounting bolt 30. Therefore, entrance of water droplets or the like from the vicinity of the mounting bolt 30 is prevented.

However, since the barring bent portion 29*a* is formed by bending the switch bracket 28 made of metal as described above, it is not possible to bend the metal at a right angle. Therefore, a gap S is produced between the barring bent portion 29*a* and the mounting bolt 30 as shown in FIG. 3. Further, the mounting bolt 30 is such that the movement of the flange portion thereof toward the inside of the panel 10 is regulated by the barring bent portion 29*a*. As a result, when the mounting bolt 30 is tightened excessively, the panel 10 close to the screw hole 12 may, in some cases, be drawn into the gap S between the barring bent portion 29*a* and the mounting bolt 30. As a result, the panel 10 is deformed as shown in FIG. 5, and water droplets or the like may, in some cases, enter into the panel 10 from such deformed portion.

SUMMARY OF THE INVENTION

The invention has been made to overcome the aforementioned problems. The object of the invention is, therefore, to provide a watertight structure of a mounting portion that can fix a fixing member to a fixed member by tightening a mounting bolt without deforming the fixed member due to excessive tightening of the mounting bolt and that can provide reliable watertightness at the time of fixing the fixing member to the fixed member using the mounting bolt.

To overcome the above problems, the present invention is provided a watertight structure of a mounting portion comprising: a screw hole formed in a fixed member; a mounting bolt having a tightening portion formed on one end thereof, having a disclike flange portion formed on the other end of the tightening portion, and being screwed into the screw hole; a fixing member having a mounting hole formed in part thereof, and being fixed to the screw hole by tightening the mounting bolt with the mounting bolt inserted into the mounting hole having the same diameter as the screw hole; a watertight member covering the fixing member, and having an annular projected portion disposed at a position corresponding to the mounting hole so that entrance of a liquid into the mounting hole and the screw hole can be prevented, the annular projected portion being larger in a radial direction than the mounting hole and smaller in a radial direction than the flange portion; and an interposing means being interposed between the flange portion and the fixing member, having a surface of contact thereof with the fixing member extending in parallel to the fixing member, being larger in a radial direction than the mounting hole and smaller in a radial direction than the annular projected portion of the watertight member, and having a length of the mounting bolt in an axial direction set so that the flange portion properly biases the annular projected portion at the time of tightening the bolt.

According to the present invention, the interposing member is integrally formed with the mounting bolt.

According to the present invention, the fixed member is a panel of a vehicle; the fixing member is a switch bracket of a watertight switch being mounted on the vehicle and being made of a conductive material; the switch bracket not only being fixed to the panel and electrically connected by tightening the mounting bolt, but also being formed so that a liquid is prevented from entering into the mounting hole and the screw hole.

Therefore, according to the present invention, the mounting bolt has a tightening portion formed on one end thereof, has a disclike flange portion formed on the other end of the tightening portion, and is screwed into a screw hole. The fixing member has a mounting hole formed in part thereof, and is fixed to the screw hole by tightening the mounting bolt with the mounting bolt inserted into the mounting hole having the same diameter as the screw hole. The watertight member covers the fixing member, and has an annular projected portion disposed at a position corresponding to the mounting hole so that entrance of a liquid into the mounting hole and the screw hole can be prevented, the annular projected portion being larger in a radial direction than the mounting hole and being smaller in a radial direction than the flange portion. The interposing means is interposed between the flange portion and the fixing member, has a surface of contact thereof with the fixing member extending in parallel to the fixing member, is larger in a radial direction than the mounting hole and smaller in a radial direction than the annular projected portion of the watertight member, and has a length of the mounting bolt in an axial direction formed so that the flange portion properly biases the annular projected portion at the time of tightening the bolt.

Further, according to the present invention, the interposing member is integrally formed with the mounting bolt. Therefore, the number of parts is not increased.

Further, according to the present invention, not only the switch bracket of the watertight switch is fixed and electrically connected to the panel of a vehicle by tightening the mounting bolt, but also entrance of a liquid to the mounting hole and the screw hole can be prevented.

DETAILED DESCRIPTION OF THE PREFERRED EMBODIMENT

A specific mode of embodiment of the invention will now be described with reference to FIGS. 1 and 2. It may be noted that it is the mounting portion of a switch shown in FIG. 3 that is featured in this mode of embodiment. Therefore, the description will center around the mounting portion.

Figure 1:
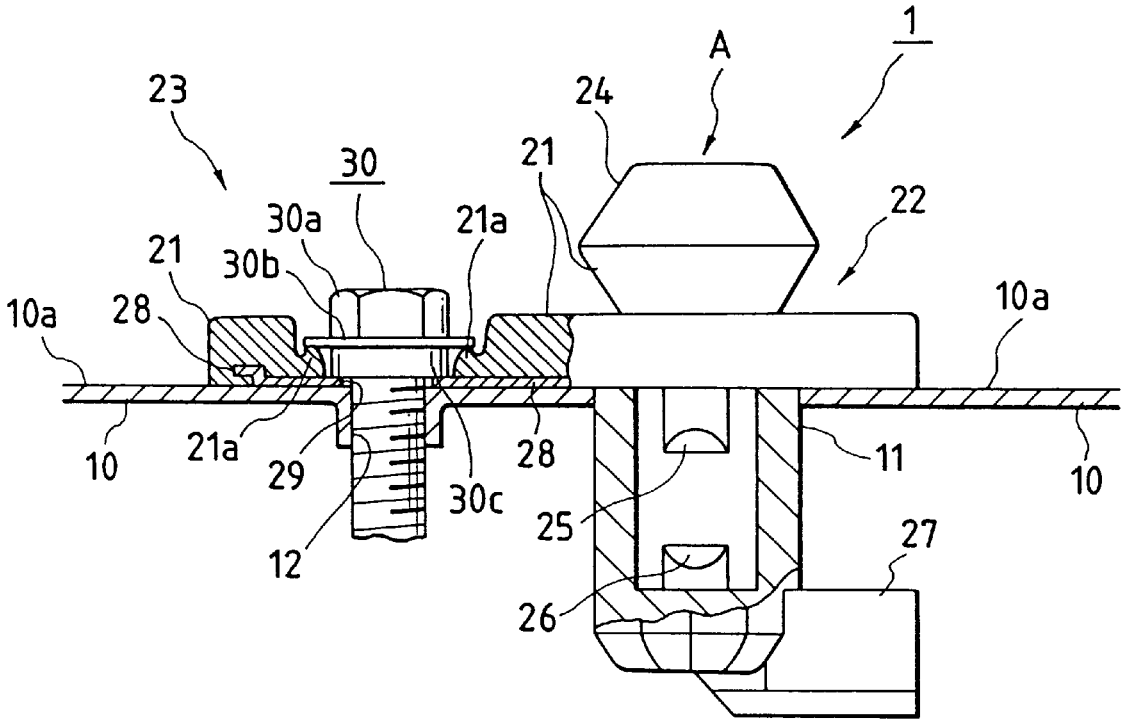
FIG. 1 a sectional view showing the main portion of a watertight switch, which is a mode of embodiment.

FIG. 1 is a watertight switch (hereinafter referred to simply as the "switch") 1. This switch 1 is distinguished from the mounting portion 23 of the switch 20 shown in FIG. 3 in the following points (1) and (2).

Figure 2:
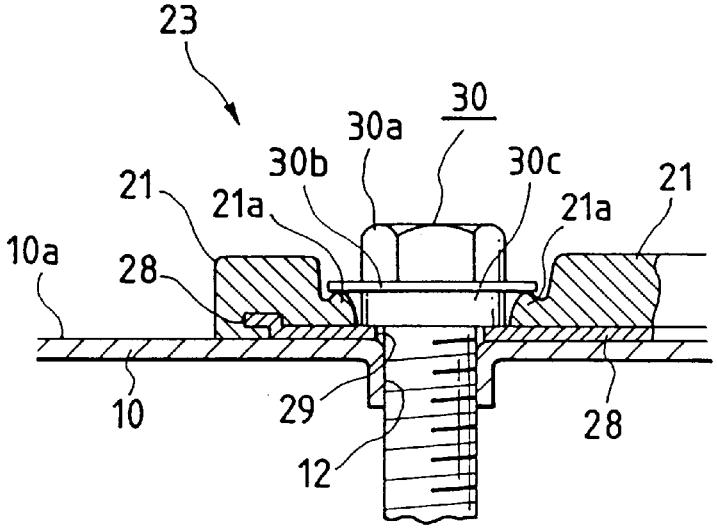
FIG. 2 is a sectional view showing the main portion of a mounting portion.
Figure 3:
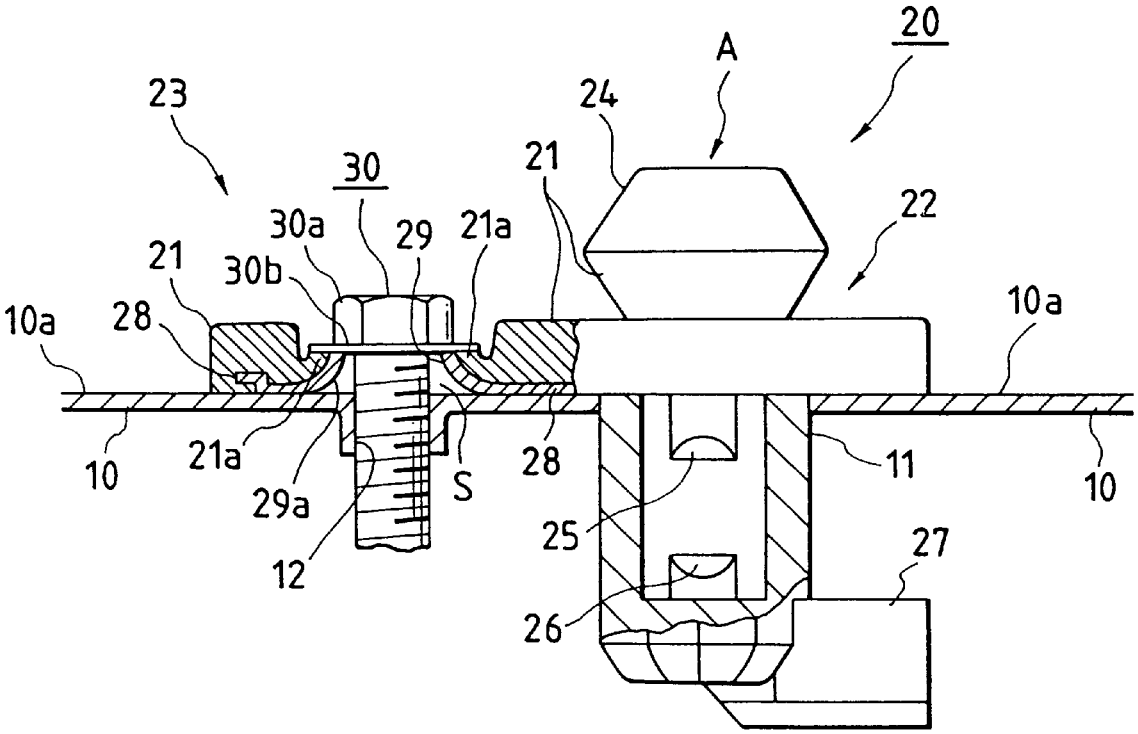
FIG. 3 PRIOR ART
FIG. 3 is a sectional view showing the main portion of a conventional watertight switch.
Figure 4:
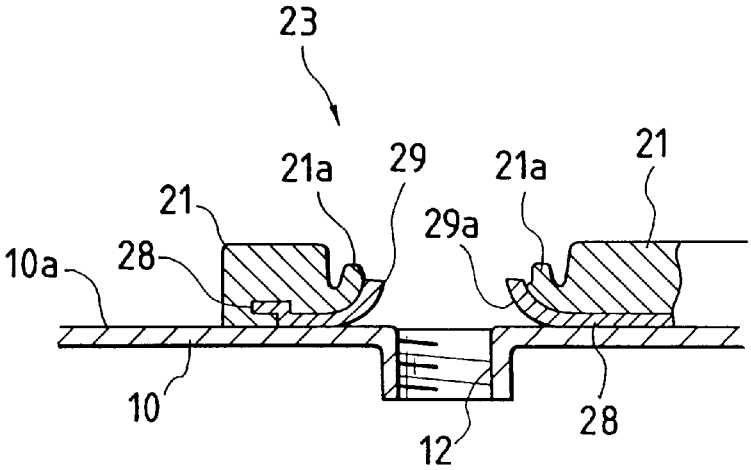
FIG. 4 PRIOR ART
FIG. 4 is a sectional view showing the main portion of a mounting portion when a mounting bolt is not tightened.
Figure 5:
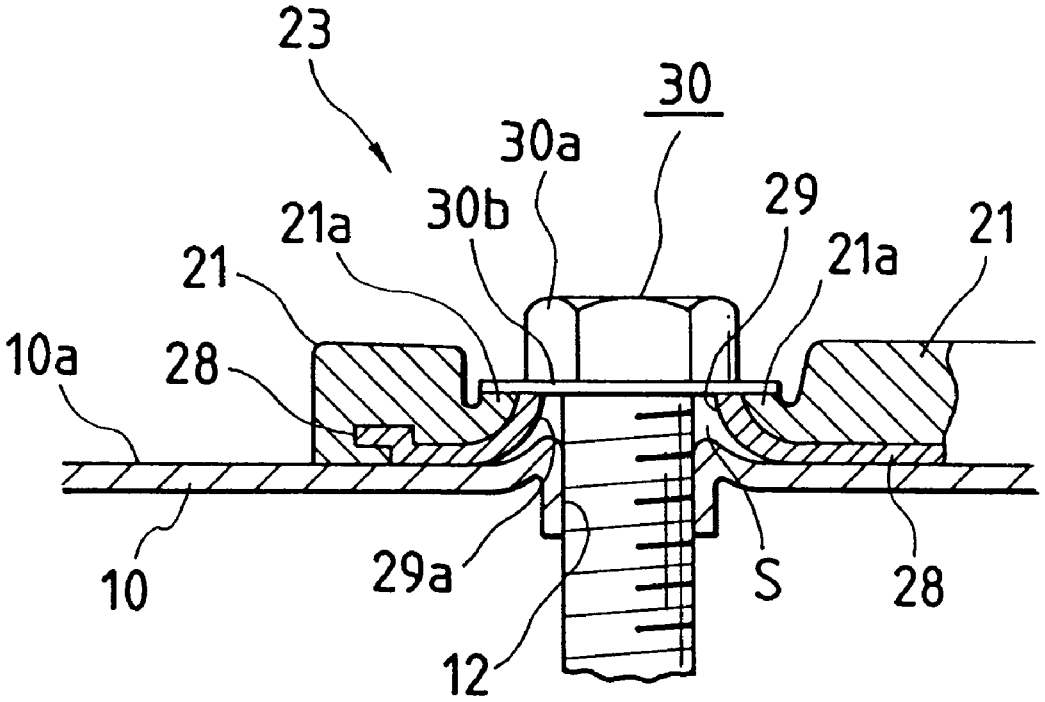
FIG. 5 PRIOR ART
FIG. 5 is a sectional view showing the main portion of the mounting portion when the mounting bolt is tightened excessively.

(1) As shown in FIGS. 1 and 2, a switch bracket 28 that serves as a fixing member is flat without having the barring bent portion 29*a*. The mounting hole 29 has substantially the same diameter as the screw hole 12 formed in the panel 10 that serves as a fixed member. Therefore, according to the thus formed switch bracket 28, no gap such as to allow the panel 10 close to the screw hole 12 to be drawn thereinto is likely to be provided. Further, by making the mounting hole 29 flat, the switch bracket 28 machining operation can be simplified.

(2) A cylindrical stepped portion 30*c* that serves as an interposing means is integrally formed on a flange portion 30*b* of the mounting bolt 30 so that a surface of contact of the stepped portion 30*c* with the switch bracket 28 extends in parallel to the switch bracket 28. That is, the mounting bolt 30 is formed of a tightening portion 30*a*, the flange portion 30*b*, and the stepped portion 30*c* in the order thus written from an end thereof. The stepped portion 30*c* is larger in a radial direction than the mounting hole 29 and smaller than the seal portion 21*a* that serves as an annular projected portion of the rubber cover 21 serving as a watertight member. Further, the length of the stepped portion 30*c* in an axial direction is determined so that when the stepped portion 30*c* is in contact with the switch bracket 28 close to the mounting hole 29, the flange portion 30*b* comes in intimate contact with the seal portion 21*a* of the rubber cover 21 so as to properly compress the seal portion 21*a*.

At the time of tightening the mounting bolt 30, not only the stepped portion 30*c* of the bolt 30 is brought into contact with the switch bracket 28 close to the mounting hole 29, but also the flange portion 30*b* of the bolt 30 compresses the seal portion 21*a* of the rubber cover 21 so as to be in intimate contact therewith. Therefore, not only the switch 1 is fixed to the panel 10 with the mounting bolt 30 tightened, but also the switch bracket 28 is electrically connected to the body through the mounting bole 30 and the screw hole 12, thereby performing the function thereof. Further, since the seal portion 21*a* of the rubber cover 21 is compressed by the flange portion 30*b* of the mounting bole 30 so as to be in intimate contact therewith, entrance of water droplets or the like from the vicinity of the mounting bolt 30 can be prevented.

Further, the switch bracket 28 is flat and the mounting hole 29 has substantially the same diameter as the screw hole 12 formed in the panel 10. Moreover, the stepped portion 30*c* of the mounting bole 30 is formed so that the surface of contact thereof with the switch bracket 28 extends in parallel to the switch bracket 28. Therefore, even if the mounting bolt 30 is tightened excessively, no such gap as to allow the panel 10 to be drawn thereinto is provided, which in turn allows the stepped portion 30*c* to be biased onto the switch bracket 28 as the mounting bolt 30 is tightened. Hence, even if the mounting bolt 30 is tightened excessively, the panel 10 will not be deformed.

As described above, the features of this mode of embodiment will hereunder be summarized.

(1) The switch bracket 28 is flat and the mounting hole 29 has substantially the same diameter as the screw hole 12 formed in the panel 10. Further, the stepped portion 30*c* of the mounting bolt 30 is formed so that the surface of contact thereof with the switch bracket 28 extends in parallel to the switch bracket 28. Therefore, even if the mounting bolt 30 is tightened excessively, no such gap as to allow the panel 10 to be drawn thereinto is provided, so that the stepped portion 30*c* biases the switch bracket 28 as the mounting bolt 30 is tightened. As a result, the panel 10 is prevented from being deformed.

(2) The switch bracket 28 is made flat without forming a barring bent portion 29*a*. Therefore, the switch bracket 28 machining operation can be simplified.

(3) The stepped portion 30*c* of the mounting bolt 30 is formed integrally with the mounting bolt 30. Therefore, the number of parts is not increased. Further, the mounting bolt 30 can be mounted with ease.

(4) The stepped portion 30*c* of the mounting bolt 30 is larger in a radial direction than the mounting hole 29 formed in the switch bracket 28 and smaller than the seal portion 21*a* of the rubber cover 21. Therefore, the mounting bolt 30 comes in contact with the switch bracket 28 reliably. That is, the switch bracket 28 is electrically connected to the body reliably.

(5) The length of the stepped portion 30*c* in an axial direction is determined so that when the stepped portion 30*c* is in contact with the switch bracket 28 close to the mounting hole 29, the flange portion 30*b* comes in intimate contact with the seal portion 21*a* of the rubber cover 21 so as to properly compress the seal portion 21*a*. Therefore, entrance of water droplets or the like from the vicinity of the mounting bolt 30 can be prevented reliably.

It may be noted that the invention may be modified in the following manner. In this case, similar functions and advantages can be obtained.

(1) While the watertight structure using a mounting bolt is applied to the mounting portion 23 of a switch in the aforementioned mode of embodiment, the invention is not applied only to switches, but may be applied to other objects to which watertight structures using a mounting bolt can be applied.

(2) While an example in which the cylindrical stepped portion 30*c* is integrally formed with the mounting bolt 30 has been proposed in the aforementioned mode of embodiment, the shape of the stepped portion 30*c* is not limited to this example. That is, the stepped portion 30*c* may be of any shape as long as:

the stepped portion is larger in a radial direction than the mounting hole 29 formed in the switch bracket 28 and smaller than the seal portion 21*a* of the rubber cover 21;

the length thereof in an axial direction is determined so that when the stepped portion 30*c* is in contact with the switch bracket 28 close to the mounting hole 29, the flange portion 30*b* comes in intimate contact with the seal portion 21*a* of the rubber cover 21 so as to properly compress the seal portion 21*a;* and the surface of contact thereof with the switch bracket 28 extends in parallel to the switch bracket 28.

Further, while the stepped portion 30*c* is formed integrally with the mounting bolt 30, the stepped portion 30*c* may also be separate from the mounting bolt 30. Further, a stepped portion whose shape is the same as that of the stepped portion 30*c* may be integrally formed with the switch bracket 28.

(3) While the tightening portion 30*a* of the mounting bolt 30 is hexagonal so as to be tightened by a spanner or the like in the aforementioned mode of embodiment, the shape of the tightening portion 30*a* is not limited thereto. For example, the tightening portion 30*a* may be formed so as to be tightened by a screwdriver.

(4) While the outer surface of the panel 10 of the switch 1 is covered with the rubber cover 21 in the aforementioned mode of embodiment, the material of which the cover 21 is made is not limited to rubber, but may be of any type as long as such material can provide watertightness.

As described in the foregoing in detail, the invention can provide a watertight structure of a mounting portion that not only allows a fixing member to be fixed without deforming the fixed member even if a mounting bolt is tightened excessively when the fixing member is fixed by tightening a mounting bolt, but also reliably provides watertightness.

What is claimed is:

1. A watertight structure of a mounting portion comprising:

a screw hole formed in a fixed member;

a mounting bolt having a tightening portion formed on one end thereof, having a flange portion formed on the tightening portion, and being screwed into the screw hole;

a fixing member having a mounting hole formed in part thereof, and being fixed to the screw hole by tightening the mounting bolt with the mounting bolt inserted into the mounting hole having approximately the same diameter as the screw hole;

a watertight member covering the fixing member, and having an annular projected portion disposed at a position corresponding to the mounting hole so that entrance of a liquid into the mounting hole and the screw hole is prevented, the annular projected portion being larger in a radial direction than the mounting hole and smaller in a radial direction than the flange portion; and an interposing member, interposed between the flange portion and the fixing member, having a surface of contact thereof with the fixing member that extends in parallel to the fixing member and in the radial direction of the mounting hole, being larger in a radial direction than the mounting hole and smaller in a radial direction than the annular projected portion of the watertight member, and having a height in an axial direction lower than the height of the annular projected portion so that the flange portion properly biases the annular projected portion at the time of tightening the bolt.

2. A watertight structure of a mounting portion according to claim 1, wherein the fixed member is a panel of a vehicle, the fixing member is a switch bracket of a watertight switch mounted on the vehicle and is made of a conductive material, and the switch bracket not only is fixed to the panel and electrically connected by tightening the mounting bolt, but also is formed so that entrance of a liquid into the mounting hole and the screw hole is prevented.

3. A watertight structure of a mounting portion according to claim 1, wherein the interposing member is integrally formed with the mounting bolt.

4. A watertight structure of a mounting portion according to claim 3, wherein the fixed member is a panel of a vehicle, the fixing member is a switch bracket of a watertight switch mounted on the vehicle and is made of a conductive material, and the switch bracket not only is fixed to the panel and electrically connected by tightening the mounting bolt, but also is formed so that entrance of a liquid into the mounting hole and the screw hole is prevented.

* * * * *